United States Patent [19]

Gendron

[11] 3,941,309

[45] Mar. 2, 1976

[54] COMBINED BROCHURE AND RETURN ENVELOPE PACKAGE

[75] Inventor: Wilfred H. Gendron, Wilbraham, Mass.

[73] Assignee: United States Envelope Company, Springfield, Mass.

[22] Filed: Apr. 3, 1973

[21] Appl. No.: 347,412

[52] U.S. Cl. ..... 229/73; 229/92.1; 282/25; 283/1 B

[51] Int. Cl.² ..... B65D 27/06

[58] Field of Search..... 229/92.1, 92.3, 68 R, 73; 282/25; 283/1 B

[56] References Cited

UNITED STATES PATENTS

| | | | |
|---|---|---|---|
| 1,424,837 | 8/1922 | Lover | 283/1 B |
| 2,835,512 | 5/1958 | Whitman | 282/25 |
| 3,718,277 | 2/1973 | Volkert | 229/73 |
| 3,802,618 | 4/1974 | Wiessner | 229/73 |

FOREIGN PATENTS OR APPLICATIONS

| | | | |
|---|---|---|---|
| 611,118 | 12/1960 | Canada | 229/92.1 |

*Primary Examiner*—William Price
*Assistant Examiner*—Bruce H. Bernstein
*Attorney, Agent, or Firm*—McCormick, Paulding & Huber

[57] ABSTRACT

A paper product intended for use as an advertising piece or the like and capable of being made from a single web of material by a web fed machine consists of a multiple paged brochure, a return mailing envelope, and a return application or order form combined in a single package adapted in one form for non-mailing uses, such as a newspaper drop-in or hand-out, and in another form as a mailing package.

9 Claims, 15 Drawing Figures

COMBINED BROCHURE AND RETURN ENVELOPE PACKAGE

BACKGROUND OF THE INVENTION

This invention relates to products made of paper or similar sheet material, and deals more specifically with such a product consisting of a multi-paged brochure, a return mailer, and an order form or other detachable page all combined into a single package adapted for use as an advertising piece or the like.

The paper package of this invention may be put to various different uses, but is particularly well adapted for use in connection with mail order advertising. In such advertising, it is desirable to supply a potential customer with information concerning the products or services offered for sale, an application or order form to be completed by the customer, and an envelope to be used by the customer in returning the application or order form to the advertiser. In the past, various different package arrangements have been proposed and used wherein two or more of these units are combined. The object of this invention is to provide an improved package combining an application or order form, a return mailing envelope, and space devoted to a printed sales message or presentation of the products or services offered by the advertiser. In particular, an object of the invention is to provide such a package which, in addition to an application or order form and return mailing envelope, includes a multi-paged brochure all of which may be used to contain a sales presentation or to give other information to the prospective customer. A further object of the invention is to provide such a package which is readily configured either for use as a newspaper drop-in, hand-out, or other non-mailed piece, or for use as a mailing piece.

SUMMARY OF THE INVENTION

The invention resides in a paper advertising piece or the like which, in addition to a return envelope, also includes a multiple paged brochure and, preferably, an additional detachable sheet usable as an application or order form. The package consists of a plurality of generally rectangular leaves which are joined to one another along one edge of the assemblage, some of the leaves forming the brochure and one of the leaves being an envelope leaf at least part of which envelope leaf is folded, glued and perforated to define an envelope separable from the remainder of the envelope leaf. The envelope leaf preferably also includes a portion defining an order or application form which is separable from the envelope and the remainder of the envelope leaf. When the package is intended for use as a mailing piece, it also further has two end leaves one of which includes a sealing flap folded over and sealed to the other end leaf to seal the package for mailing.

DETAILED DESCRIPTION OF THE PREFERRED EMBODIMENTS

Embodiment of FIGS. 1 to 4

Figure 1:
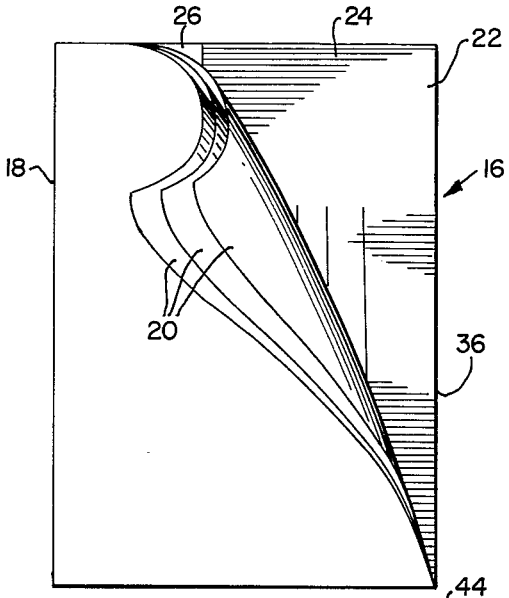
FIG. 1 is a front view of a combined brochure and return envelope package embodying this invention, the sheets of the brochure being shown partially turned to reveal a part of the return envelope.
Figure 2:
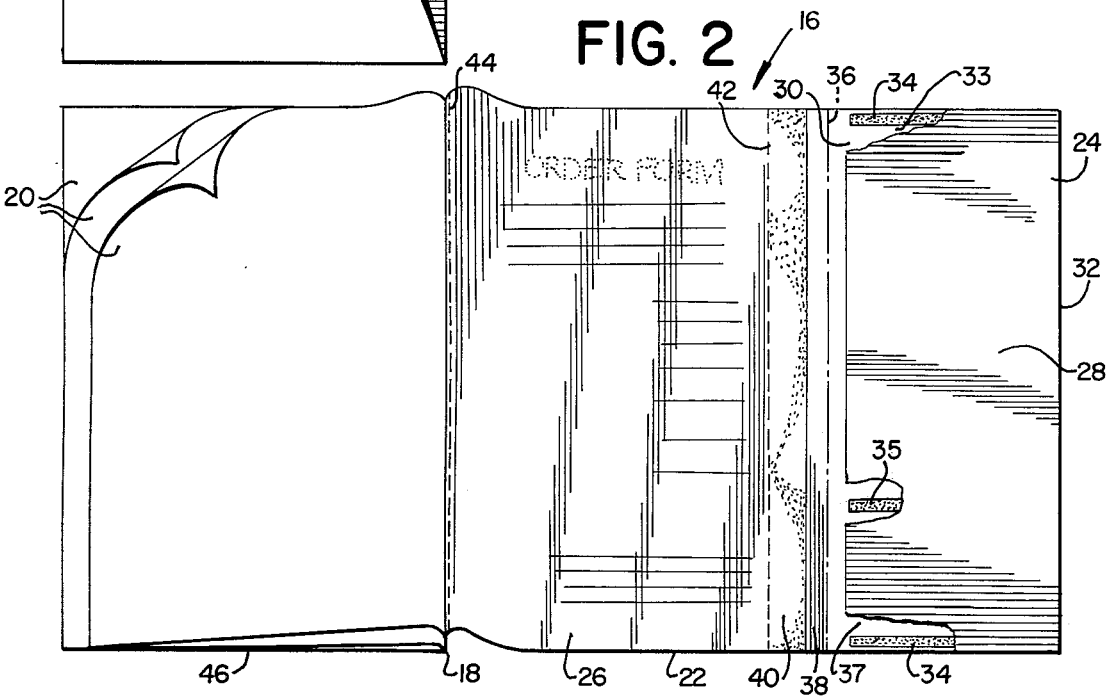
FIG. 2 is a view showing the combined brochure and return envelope package of FIG. 1 in an open condition and with part of the return envelope being shown broken away to better reveal its structure.
Figure 3:
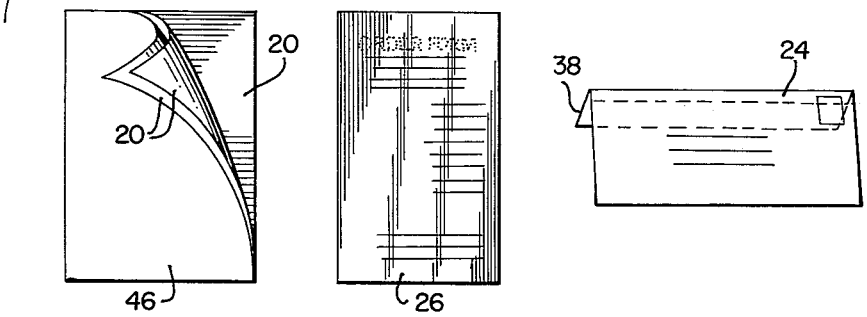
FIG. 3 is a view showing the brochure, return envelope, and order form of the package of FIG. 1 separated from one another.

First considering FIGS. 1, 2 and 3, these figures show a combined brochure and return envelope package 16 made of paper or similar sheet material and comprising one embodiment of the invention. The package 16, as shown in FIG. 1, contains a number of leaves which are secured to one another along the package's left-hand edge 18. Three of the leaves, indicated at 20, 20, are of single thickness and defines pages of a brochure on which advertising copy or the like may be printed. The leaf 22, when the package is in the substantially unopened condition of FIG. 1, is comprised of a number of layers of material folded upon themselves and so perforated and adhered to one another as to provide both a return envelope 24 and an additional page portion 26 which may be used to receive additional advertising copy or the like or which may be used to serve as an order form or the like to be returned in the return envelope.

FIG. 2 shows the package 16 opened to the envelope leaf 22 and the leaf 22 unfolded to better reveal the return envelope 24 and the associated leaf portion 26. Although the leaf portion 26 may be used for other purposes, it is preferably used as an order form and is hereinafter referred to as such.

The return envelope 24, as best shown in FIG. 2, consists of a rear panel 28 overlying a front panel 30. At the bottom edge of the envelope the two panels 28 and 30 are attached to one another along a fold line 32 and at the two ends of the envelope the panels 28 and 30 are secured to one another by lines of adhesive 34, 34. An additional line of adhesive 35 is used to divide the envelope pocket into a main pocket 33 and a smaller pocket 37 which may be used to receive one or more coins, coupons or tokens in the return mailing. Connected to the front panel 30 along a fold line 36 is a sealing flap 38 containing a line of remoistenable adhesive 40. The sealing flap is of an elongated shape and has an inner longitudinal edge defined by the fold line 36 and an outer longitudinal edge defined by a line of weakening such as the illustrated line of perforations 42. When the package 16 is in the closed or unopened condition of FIG. 1, the return envelope 24 is folded along the fold line 36 into overlying relationship with the order form 26.

The return envelope 24 is attached to the order form 26 along the perforated line 42 which allows the envelope to be readily detached from the order form by tearing along the line 42. After the envelope is so removed, it may, of course, be sealed for mailing by moistening the adhesive 40 and folding the seal flap 38 into overlying relationship with the rear panel 28.

The order form 26 is connected to the remainder of the package 16 along another line of perforation 44. Therefore, by tearing along the line of perforation 42 and the line of perforation 44, the package 16 may be separated into three separate items, namely the return envelope 24, the order form 26 and a brochure 46 made up of the three pages 20, 20. These three items as separated from one another are shown in FIG. 3.

Figure 4:
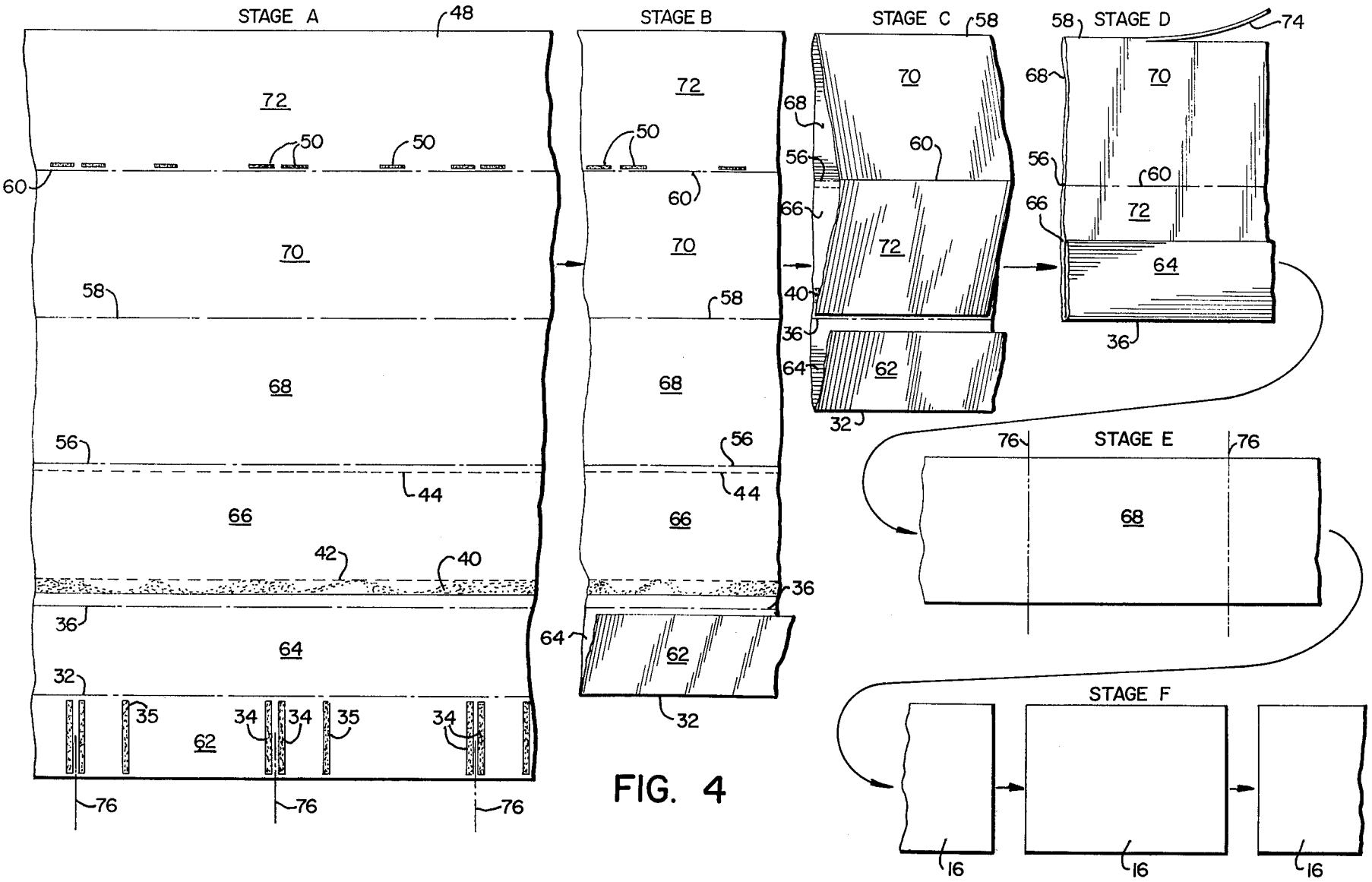
FIG. 4 is a view showing the successive stages in the method for manufacturing packages such as shown in FIG. 1 from a single web of sheet material.

One of the advantages of the above-described package 16 is that it may readily be made through the use of a web fed forming machine wherein a web of paper or the like from which the package is made is moved continuously through the machine. FIG. 4 shows the various steps involved in a method of making packages such as the package 16 of FIGS. 1 to 3, the various steps of which method, it will be understood, may readily be performed at different stations in a web fed machine. Referring to FIG. 4, the illustrated method progresses from the left of the figure toward the right, in the sequence indicated by the dashed lines and arrows, and the illustrated stages of the method are identified as Stage A, Stage B, etc.

In FIG. 4 the web of sheet material from which the packages are made is indicated at 48. Prior to reaching the illustrated Stage A, the web 48 is perforated along the longitudinally extending lines 42 and 44, remoistenable adhesive is applied and dried along the line 40, and moist adhesive is applied along the illustrated lines 34, 34, 35, 35 and 50, 50. The broken lines 32, 36, 56, 58 and 60 are fold lines along which the web 48 is subsequently folded. These fold lines divide the web 48 transversely into a number of longitudinally extending strips 62, 64, 66, 68, 70 and 72. It will, of course, be understood that prior to reaching Stage A, the various steps involved in perforating the web along the lines 42 and 44 and in applying adhesive to the web may be performed in any desired and convenient sequence. Also, if desired, some of these steps, such as the application of the glue to the lines 50, 50 or the perforation of the lines 42 and 44, may be performed subsequently to the illustrated Stage A, it being understood that FIG. 4 shows only one of several specific sequences by which the various steps of the method may be performed.

Following the illustrated Stage A of FIG. 4, the web 48 is folded along the fold line 32 to bring the strip 62 into overlying relationship with the strip 64, as shown at Stage B, and in doing this the two strips 62 and 64 are secured to one another by the lines of adhesive 34, 34 and 35, 35. Next, as shown at Stage C, the web is folded along the fold line 58 to bring the strips 70 and 72 into overlying relationship with the strips 68 and 66, respectively. The lines of glue 50, 50 on the strip 72 are so located that as the strip 72 is flattened against the strip 66 the glue lines 50, 50 engage the strip 66 within the space between the fold line 56 and the perforated line 44, thereby securing the four strips 66, 68, 70 and 72 to one another adjacent the now superimposed fold lines 60 and 56.

Subsequent to Stage C, the two folded and joined strips 62 and 64 are folded along the fold line 36 to bring them into overlying relationship with the strip 72, as shown at Stage D. Also, at Stage D the strips 68 and 70 are separated from one another adjacent the fold line 58, as indicated at 74, by cutting away a small marginal portion of both of said strips along a line of cut located parallel and close to the line 58.

Following Stage D, the two strips 68 and 70 are folded along the superimposed fold lines 56 and 60, as the final folding stage of the method, to define a stack of superimposed strips as shown at Stage E. This stack is then cut along transversely extending lines of cut 76, 76, each of which is located between a respective pair of closely spaced glue lines 34, 34 as shown at Stage A, to separate the stack into individual packages 16, 16, as shown at Stage F.

Embodiment of FIGS. 5 to 9

The package 16 of FIGS. 1 to 4 is one primarily intended for use as a non-mailed item such as a handout or newspaper or magazine drop-in. FIGS. 5 to 9 show a package 78 comprising another embodiment of the invention and adapted for use as a direct mailing piece.

Figure 6:
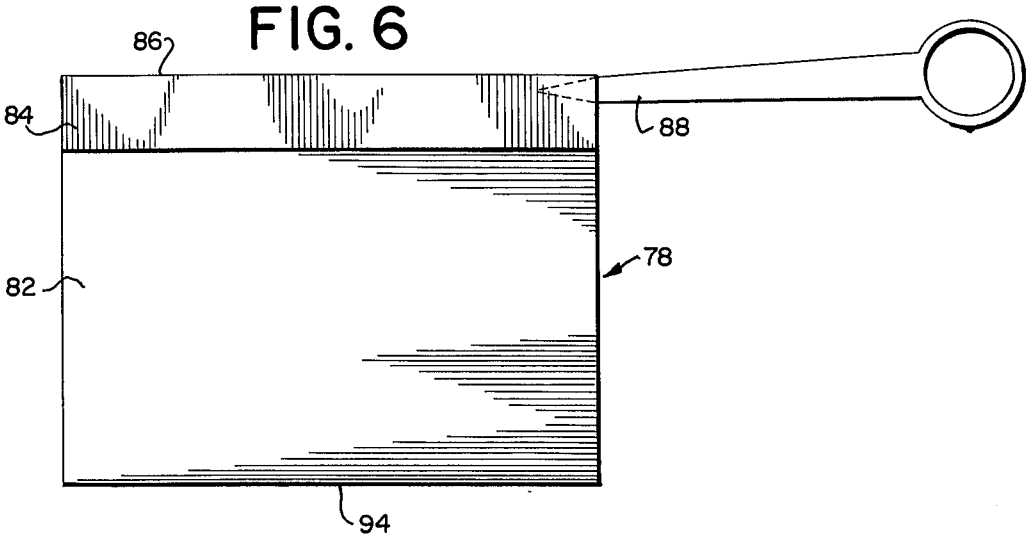
FIG. 6 is a rear view of the package of FIG. 5 and additionally shows the package in the process of being opened by an opening implement.
Figure 5:
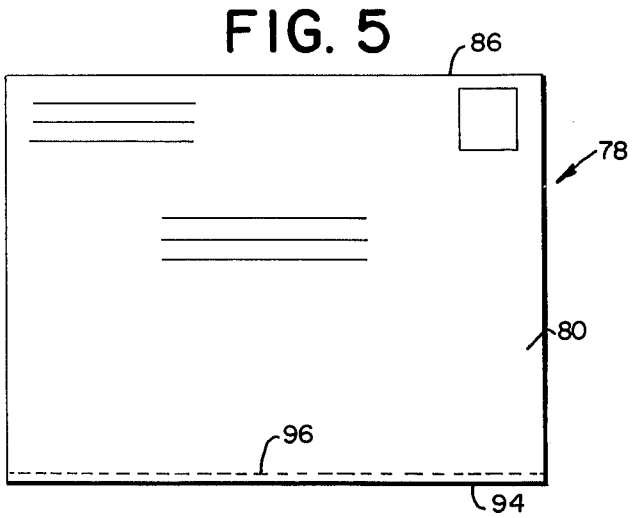
FIG. 5 is a front view of a package forming an alternative embodiment of this invention.

Referring to FIGS. 5 to 8 which show the structure of the package 78, this package includes a plurality of leaves including two end leaves 80 and 82. The end leaf 80 includes an extension 84 which is folded about the fold line 86, forming one edge of the package and preferably weakened by perforations, into overlying relationship with the end leaf 82. The extension 84 is adhesively adhered to the end leaf 82 to initially form the package 78 into a sealed, closed unit suitable for mailing, as shown in FIGS. 5 and 6. The end leaf 80 is taken to be the front panel of the sealed unit and preferably, as shown in FIG. 5, includes space for receiving a mailing address, a return address and a stamp or mailing permit imprint for mailing purposes. As indicated in FIG. 6, the sealed package may be opened by inserting an opening implement 88 between the end leaves 80 and 82 to sever the end leaf 80 from its extension 84 by tearing along the fold line 86.

Figure 8:
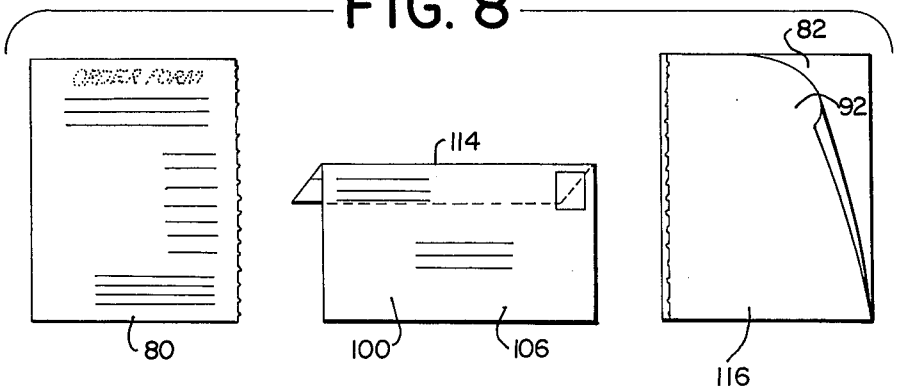
FIG. 8 is a view showing the brochure, return envelope and order form of the package of FIG. 5 separated from one another.
Figure 7:
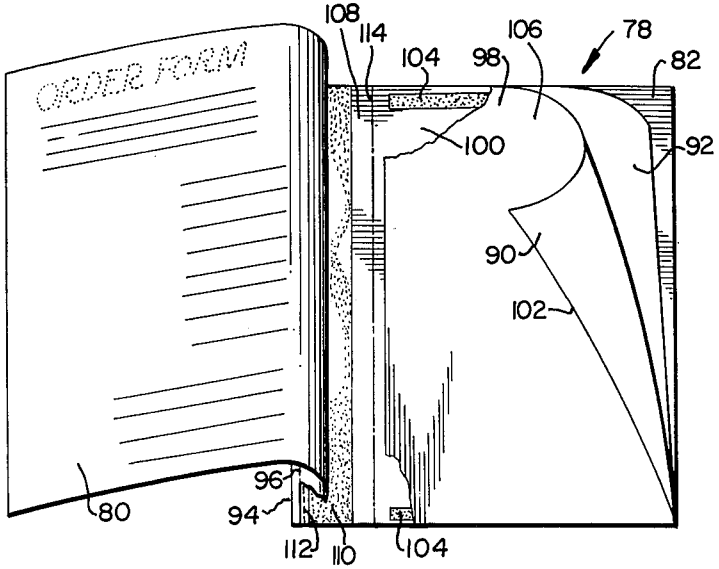
FIG. 7 is a view showing the package of FIG. 5 in an open condition.

FIG. 7 shows the package 78 in an opened condition and from this figure it will be noted that the package, in addition to the end leaves 80 and 82, also includes an envelope leaf 90 and an additional single thickness leaf 92, all of the leaves 80, 82, 90 and 92 being joined to one another along the left-hand edge 94. The end leaf 80 is joined to the remainder of the package 78 by a perforated line 96 located close and parallel to the edge 94. The leaf 80 may, therefore, be readily removed from the remainder of the package by tearing along the line 96 and preferably the inside surface of this leaf is printed to serve as an order form or the like as illustrated in FIGS. 7 and 8. The envelope leaf 90 is comprised of two layers 98 and 100 of material folded upon one another about a fold line 102 and adhered to one another by adhesive lines 104, 104 to form a return envelope 106. As part of the envelope 106 the layer 100 includes a sealing flap 108 containing a line of remoistenable adhesive 110. The sealing flap 108 is of an elongated shape and has an inner longitudinal edge defined by a fold line 114 and an outer longitudinal edge defined by a perforated line 112. The sealing flap 108 is connected to the remainder of the package 78 by the perforated line 112, which directly underlies the perforated line 96, so that by tearing along the line 112 the envelope 106 may be removed from the package. After the envelope 106 is removed from the package, the adhesive 110 may be moistened and the sealing flap 108 may be folded along the fold line 114 to seal the flap to the layer 98 and to thereby close the return envelope 106 for mailing.

FIG. 8 shows the package 78 separated into its separate components obtained by first opening the package by tearing along the fold line 86, as shown in FIG. 6, and by then tearing along the perforated lines 96 and 112. The resulting components are the order form 80, the return envelope 106 and a brochure 116 comprised of the two leaves 92 and 82.

Figure 9:
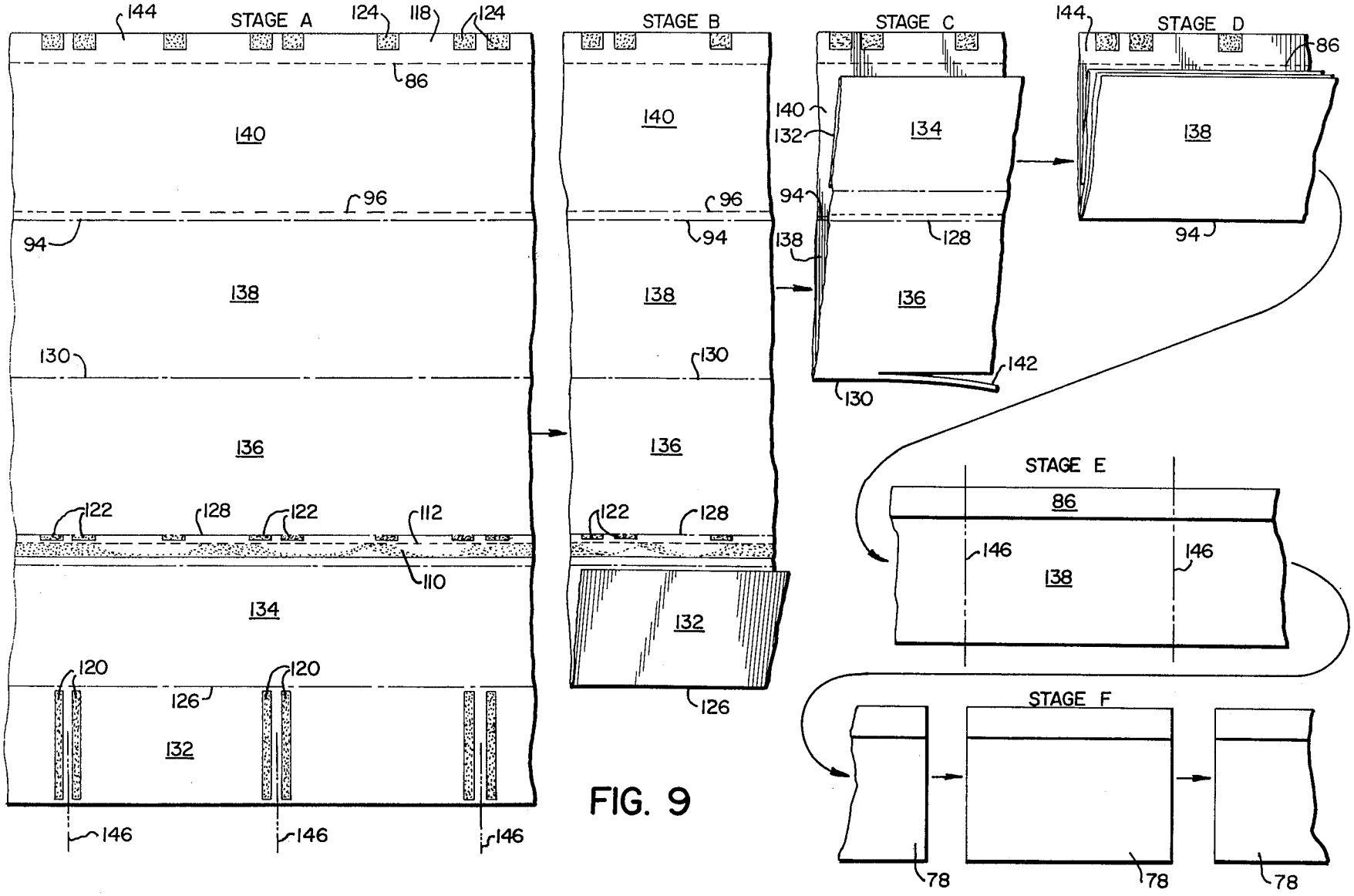
FIG. 9 is a view showing the successive stages in the method for manufacturing packages such as shown in FIG. 5 from a single web of sheet material.
Figure 10:
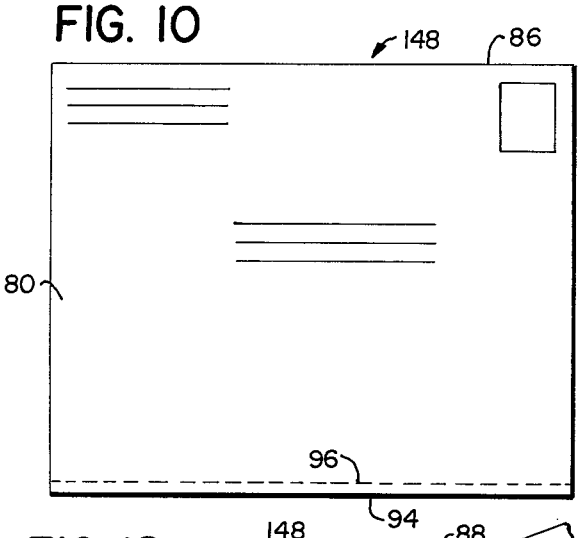
FIG. 10 is a front view of a package comprising still another embodiment of this invention.
Figure 11:
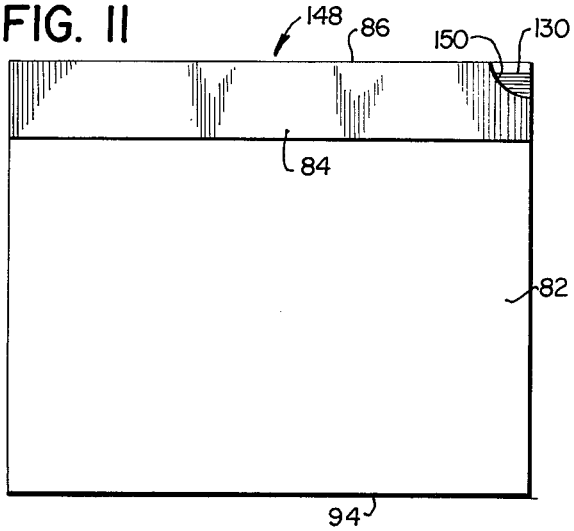
FIG. 11 is a rear view of the package of FIG. 10.

FIG. 9 shows a method by which a continuously moving web of paper or similar sheet material may be formed in various stages to produce packages similar to the package 78 of FIGS. 5 to 8. Referring to FIG. 9, prior to reaching the illustrated Stage A, the web 118 is perforated along three longitudinally extending lines of perforation 86, 96 and 112. It is also provided with a line 110 of remoistenable adhesive and lines or spots of moist adhesive as indicated at 120, 120, 122, 122, and 124, 124. The broken lines 126, 128, 130 and 94 are fold lines along which the web 118 is subsequently folded and they transversely divide the web 118 into a number of longitudinally extending strips 132, 134, 136, 138 and 140.

Progressing from Stage A, the web 118 is first folded along the fold line 126 to bring the strip 132 into overlying relationship with the strip 134, which two strips 132 and 134 are consequently adhered to one another by the adhesive lines 120, 120. Next, as shown in Stage C, the web is folded along the fold line 130 to bring the strip 136 into overlying relationship with the strip 138 and to bring the joined strips 134 and 132 into overlying relationship with the strip 140. At this time, the glue spots 122, 122 which are located on the strip 134 between the perforated line 112 and the fold line 128 engage the strip 140 between the perforated line 96 and the fold line 94 to thereby join together the strips 134, 136, 138 and 140 adjacent the now superimposed fold lines 128 and 94. Also, as shown at Stage C, after folding about the fold line 130 the two strips 136 and 138 are separated from one another adjacent the fold line 130, as indicated at 142, by severing them along a line of cut located parallel and close to the fold line 130.

Thereafter, as shown at Stage D, the web is folded about the superimposed fold lines 128 and 94, and then the extension 144 of the strip 140 is folded about the perforated line 86 to bring such extension into overlying relationship with the strip 138 to which it is adhered by the glue spots 124, 124, as shown at Stage E.

Finally, as shown in Stage F, the stack of overlying strips represented at Stage E is cut along transverse cut lines 146, 146 to separate the stack into separate sealed packages 78, 78, one cut line 146 being located between each closely adjacent pair of glue lines 120, 120, as shown at Stage A.

Embodiment of FIGS. 10 to 15

Figure 15:
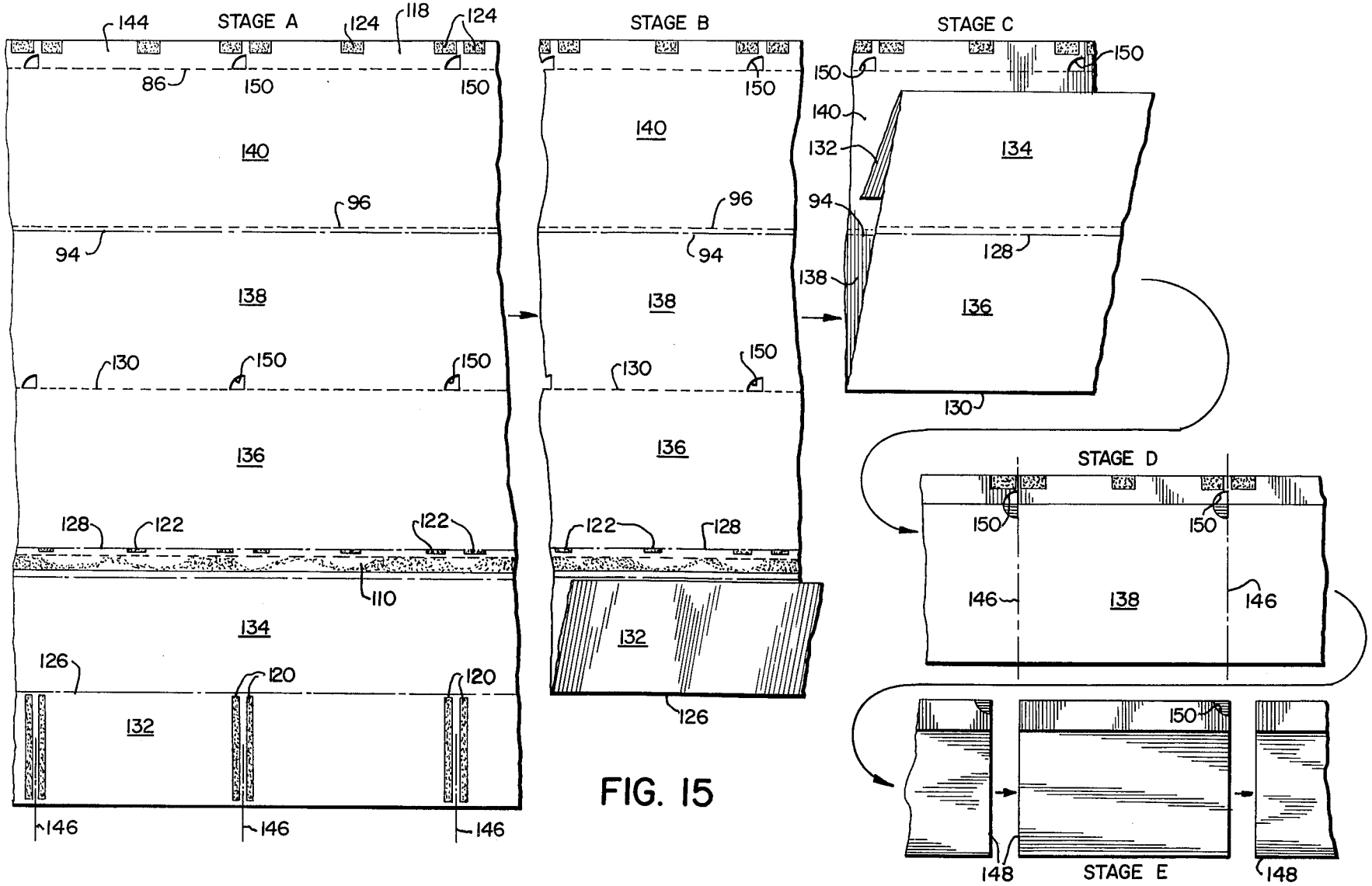
FIG. 15 is a view showing the successive stages in the method for manufacturing packages such as shown in FIG. 10 from a single web of sheet material.

In connection with the package 78 of FIGS. 5 to 9, it should be noted that, due to the cut indicated at 142 in Stage C of FIG. 9, the leaves 82 and 92 are separated from one another along their right-hand edges, as viewed in FIG. 7, even before the package is opened as shown in FIG. 6. This separation of the two leaves 82 and 92 is not entirely necessary, and if desired, the leaves 82 and 92 may be left joined in the sealed package with the package being so designed that as it is opened with an opening implement the two leaves 82 and 92 are separated from one another simultaneously with the package being torn along the perforated line 86. FIGS. 10 to 15 show a package 148 of the latter type of construction. The package 148 is generally similar to the package 78 of FIGS. 5 to 9 and the method by which the package 148 is made may be generally similar to the method by which the package 78 is made. Therefore, in FIGS. 10 to 14 parts of the package 148 which are basically identical to parts of the package 78 have been given the same reference numbers as the corresponding parts of the package 78 and will not be redescribed in detail. Likewise, in FIG. 15, showing the method for making the package 148, features of FIG. 15 which are similar to corresponding features of FIG. 9 have been given the same reference numerals as in FIG. 9 and will not be redescribed in detail.

Figure 12:
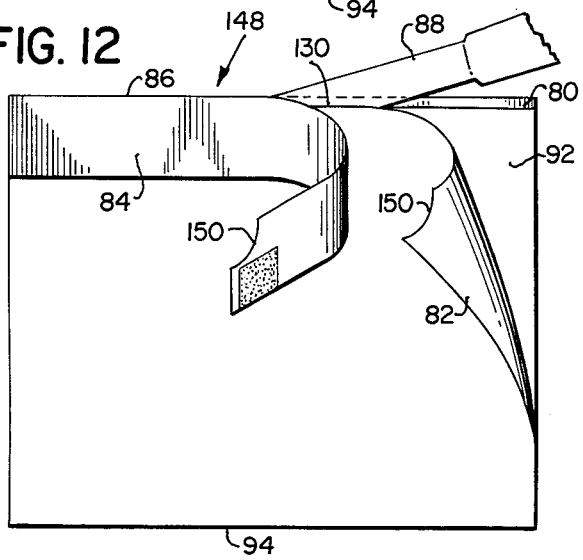
FIG. 12 is similar to FIG. 11 but shows the package partially opened.
Figure 13:
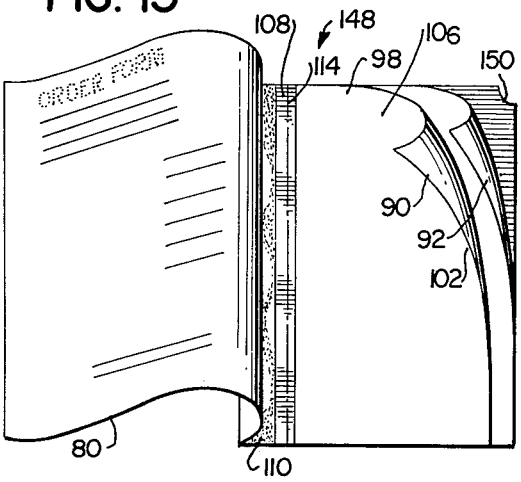
FIG. 13 is a view showing the package of FIG. 10 in an open condition.
Figure 14:
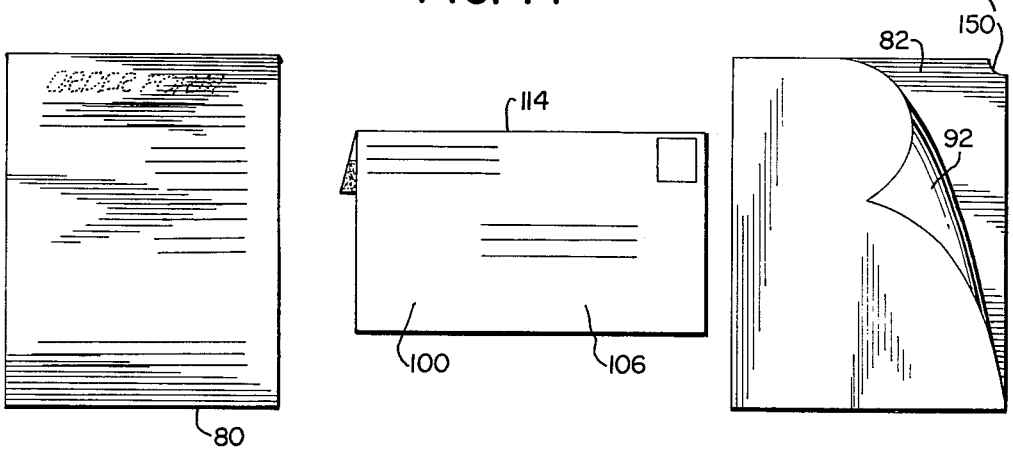
FIG. 14 is a view showing the return envelope, brochure and order form of the FIG. 10 package separated from one another.

Referring first to FIGS. 10 to 14, the package 148 there illustrated is similar to the package 78 except that, as shown best in FIG. 12, in the sealed condition of the package the two leaves 82 and 92 are joined to one another about a fold line 130 located closely adjacent to and parallel with the perforated fold line 86 by which the extension 84 is joined to the leaf 80. Therefore, when the package 148 is to be opened, the opening may be accomplished by using an opening implement 88 placed between the two leaves 82 and 92, as shown in FIG. 12, and moved so as to simultaneously tear along the line 130 and along the line 86, thereby simultaneously separating the leaves 82 and 92 from one another and separating the extension 84 from the leaf 80 to open the package. To facilitate the proper insertion of the tool 88 between the two leaves 82 and 92 the package 148, as shown best in FIG. 11, preferably has a quarter-round cutout 150 in the extension 84 and a similar registering quarter-round cutout 150 in the leaf 82 adjacent one corner of the package so that a portion of the folded edge 130 is made visible.

Turning to FIG. 15, the illustrated process is similar to that shown in FIG. 9 except that prior to arriving at Stage A the web 118 is cut to define a series of quarter-round cutouts 150, 150 in the strip 140 and to define a similar series of quarter-round cutouts 150, 150 in the strip 138. The process of FIG. 15 further differs from the process of FIG. 9 in that at Stage C the fold line 130 is left intact rather than being severed from the web as shown at 142 in FIG. 9.

I claim:

1. A combined brochure and return envelope package comprising a plurality of rectangular leaves of sheet material of approximately the same size overlying one another to form an assemblage of said leaves and which leaves are joined to one another along one bound edge of said assemblage, said plurality of leaves including a plurality of pages made of a single thickness of said sheet material and also including at least one envelope leaf which envelope leaf throughout at least a portion of its extent comprises two overlying panels of said sheet material joined to one another to form an envelope, said envelope leaf including an elongated sealing flap connected with one of said two overlying panels and forming part of said envelope, said sealing flap having an inner longitudinal edge along which it is connected to said one of said two overlying panels and an outer longitudinal edge parallel to said inner longitudinal edge, said envelope leaf also including a first line of weakening arranged parallel to said one bound edge of said assemblage and located between said envelope and said one bound edge, which first line of weakening is colinear with and defines said outer longitudinal edge of said sealing flap, to enable said envelope to be separated from said envelope leaf by tearing along said line of weakening, said envelope leaf including second portion made of a single thickness of said sheet material and located between said bound edge of said assemblage and said first line of weakening.

2. A combined brochure and return envelope package as defined in claim 1 further characterized by said envelope leaf including a second line of weakening extending across said second portion thereof parallel and adjacent to said one bound edge of said assemblage, said first line of weakening being located farther from said one edge of said assemblage than said second line of weakening so as to define between said two lines of weakening a single thickness third panel and whereby both said single thickness third panel and said envelope may be separated from one another and from the remainder of said assemblage by tearing along said two lines of weakening.

3. A combined brochure and return envelope package comprising a plurality of rectangular leaves of sheet material of approximately the same size overlying one another to form an assemblage of said leaves and which leaves are joined to one another along one bound edge of said assemblage, said plurality of leaves including a plurality of pages made of a single thickness of said sheet material and also including at least one envelope leaf which envelope leaf throughout at least a portion of its extent comprises two overlying panels of said sheet material joined to one another to form an envelope, said envelope leaf including an elongated sealing flap connected with one of said two overlying panels and forming part of said envelope, said sealing flap having an inner longitudinal edge along which it is connected to said one of said two overlying panels and an outer longitudinal edge parallel to said inner longitudinal edge, said envelope leaf also including a first line of weakening arranged parallel to said one bound edge of said assemblage and located between said envelope and said one bound edge, which first line of weakening is colinear with and defines said outer longitudinal edge of said sealing flap, to enable said envelope to be separated from said envelope leaf by tearing along said line of weakening, said envelope leaf including a single thickness third panel located between said one bound edge of said assemblage and said first line of weakening, and said envelope being folded relative to said third panel along one of said longitudinal edges of said sealing flap so as to be interposed between said third panel and the adjacent one of said pages.

4. A combined brochure and return envelope package as defined in claim 3 further characterized by said sealing flap including a quantity of activatable adhesive for sealing said sealing flap to said envelope.

5. A combined brochure and return envelope package as defined in claim 3 further characterized by said envelope leaf including a second line of weakening arranged parallel to and adjacent said one bound edge of said assemblage, said two lines of weakening being spaced from each other with said second line of weakening being closer to said one bound edge than said first line of weakening, said third panel extending from said first line of weakening to said second line of weakening.

6. A combined brochure and return envelope package comprising a plurality of rectangular leaves of sheet material of approximately the same size overlying one another to form an assemblage of said leaves and which leaves are joined to one another along one bound edge of said assemblage, said plurality of leaves including a plurality of pages made of a single thickness of said sheet material and also including at least one envelope leaf which envelope leaf throughout at least a portion of its extent comprises two overlying panels of said sheet material joined to one another to form an envelope, said envelope leaf including an elongated sealing flap connected with one of said two overlying panels and forming part of said envelope, said sealing flap having an inner longitudinal edge along which it is connected to said one of said two overlying panels and an outer longitudinal edge parallel to said inner longitudinal edge, said envelope leaf also including a first line of weakening arranged parallel to said one bound edge of said assemblage and located between said envelope and said one bound edge, which first line of weakening is colinear with and defines said outer longitudinal edge of said sealing flap, to enable said envelope to be separated from said envelope leaf by tearing along said line of weakening, said leaves of said assemblage including two end leaves which two end leaves are other than said envelope leaf so that said envelope leaf is interposed in said assemblage between said two end leaves, one of said two end leaves at the edge thereof opposite said one bound edge of said assemblage having a fold line and a closing flap connected to the remainder of said one end leaf along said fold line and foldable about said fold line into overlying relationship with the other of said two end leaves, and means for bonding said closing flap to said other end leaf for closing said assemblage along the edge thereof opposite to said one bound edge.

7. A combined brochure and return envelope package as defined in claim 6 further characterized by said one end leaf including a line of weakening co-linear with said fold line to facilitate tearing along said fold line for the purpose of opening said assemblage along said edge opposite from said bound edge.

8. A combined brochure and return envelope package as defined in claim 6 further characterized by said plurality of leaves including a single thickness leaf directly underlying said other end leaf, said latter single thickness leaf and said other end leaf being joined to one another along the edge of said assemblage opposite from said bound edge by a fold line which fold line is located adjacent to and inboard of said fold line of said one end leaf so that when opening said package an implement may be placed between said other end leaf and said directly underlying leaf and thereafter moved in such a manner as to simultaneously tear both of said fold lines to open said package and separate said other end leaf from said directly underlying leaf.

9. A combined brochure and return envelope package as defined in claim 8 further chracterized by said assemblage having two spaced end edges arranged perpendicular to said one bound edge and to said edge opposite said one bound edge, and said closing flap and said other end leaf at the corner of said assemblage defined by the intersection of said opposite edge and one of said end edges each having a cutout portion extending from said one end edge to said opposite edge, said two cutout portions being registered with one another to aid in the insertion of an opening implement between said other end leaf and said directly underlying leaf.

* * * * *